US007670531B2

(12) United States Patent
Suzuki et al.

(10) Patent No.: US 7,670,531 B2
(45) Date of Patent: Mar. 2, 2010

(54) METHOD FOR PRODUCING FORMED WOODEN ARTICLE

(75) Inventors: Tatsuya Suzuki, Tokyo (JP); Hisashi Nishimura, Yokohama (JP); Hiroyuki Amino, Fujinomiya (JP)

(73) Assignee: Olympus Corporation, Tokyo (JP)

( * ) Notice: Subject to any disclaimer, the term of this patent is extended or adjusted under 35 U.S.C. 154(b) by 949 days.

(21) Appl. No.: 11/371,656

(22) Filed: Mar. 8, 2006

(65) Prior Publication Data

US 2006/0261519 A1 Nov. 23, 2006

Related U.S. Application Data

(63) Continuation of application No. PCT/JP2006/300902, filed on Jan. 16, 2006.

(30) Foreign Application Priority Data

Feb. 25, 2005 (JP) ..... P2005-050814
Feb. 25, 2005 (JP) ..... P2005-050815

(51) Int. Cl.
*B28B 3/00* (2006.01)

(52) U.S. Cl. ..... 264/296; 264/138; 264/163; 264/294; 264/295; 264/320; 264/325; 144/349; 144/350; 144/359; 144/360; 144/381; 144/33; 100/39; 100/42; 100/94

(58) Field of Classification Search ..... 264/138, 264/294, 325, 295, 296, 163, 320; 144/349, 144/350, 381, 359, 360, 33
See application file for complete search history.

(56) References Cited

U.S. PATENT DOCUMENTS 213,179 A * 3/1879 DeForest ..... 144/381
416,505 A * 12/1889 Schnabel ..... 297/452.21
2,093,652 A * 9/1937 Widmer et al. ..... 264/75

(Continued)

FOREIGN PATENT DOCUMENTS

JP 08-025301 1/1996

(Continued)

OTHER PUBLICATIONS

Machine translation of JP08-025301.*

(Continued)

*Primary Examiner*—Joseph S Del Sole
*Assistant Examiner*—Timothy Kennedy
(74) *Attorney, Agent, or Firm*—Hogan & Hartson LLP

(57) ABSTRACT

A method for producing a formed wooden article by cutting out a primary blank member from a raw wood and forming the same into a final three-dimensional shape having a substantially uniform thickness, comprises: a primary compression step in which the primary blank member is compressed by primary molding dies, and the primary blank member is processed into a primary compressed article having a high compression portion in a vicinity of portions of the primary blank member corresponding to a die surface; a secondary blank processing step in which the primary compressed article is cut and processed into a secondary blank member; and a secondary compression step in which the secondary blank member is compressed by using secondary molding dies and the final three-dimensional shape is transferred onto the secondary blank member.

10 Claims, 9 Drawing Sheets

U.S. PATENT DOCUMENTS

| | | | | |
|---|---|---|---|---|
| 2,488,301 | A | 11/1949 | Lundstrom | |
| 3,256,375 | A * | 6/1966 | Bolelli et al. | 264/294 |
| 4,175,105 | A * | 11/1979 | Luck et al. | 264/112 |
| 4,175,106 | A * | 11/1979 | Clarke et al. | 264/118 |
| 7,108,031 | B1 * | 9/2006 | Secrest | 144/358 |
| 7,131,471 | B2 | 11/2006 | McIntosh | |
| 2006/0048852 | A1 | 3/2006 | McIntosh | |

FOREIGN PATENT DOCUMENTS

| | | |
|---|---|---|
| JP | 11-077619 | 3/1999 |
| WO | 2004056542 A1 | 7/2004 |

OTHER PUBLICATIONS

Machine translation of JP 08-025301, provided by JPO, retrieved Feb. 13, 2009.*

Japanese language Decisions to Grant a Patent and their English language translations for corresponding Japanese application Nos. 2005050814 and 2005050815 list the references above.

* cited by examiner

METHOD FOR PRODUCING FORMED WOODEN ARTICLE

PRIORITY CLAIM

This application is continuation application of a PCT Application No. PCT/JP2006/300902, filed on Jan. 16, 2006, entitled "METHOD FOR PRODUCING FORMED WOODEN ARTICLE" whose priority is claimed on Japanese Patent Application No. 2005-050814, filed on Feb. 25, 2005, and on Japanese Patent Application No. 2005-050815 filed on Feb. 25, 2005, the contents of which are incorporated herein by reference.

BACKGROUND OF THE INVENTION

1. Field of the Invention

The present invention relates to a method for producing a formed wooden article, in particular, to a method for producing a structure with high strength, which is comparatively thin, and has substantially constant thickness, for example, a structure such as a box, a casing, a container, a cover, or a shell-shaped member, which has an opening at one side, by compressing and forming a wooden material.

2. Description of Related Art

Conventionally, it has been proposed that, through press-forming a plate-shaped wooden material in an atmosphere of water vapor at high temperature by using molding dies, a three-dimensionally shaped formed wooden article be produced.

Generally, since a wooden material is aggregate of wooden fibers in which cell walls extend in the growing direction of the wood, the strength in the fibrous direction remarkably differs from the strength in the direction orthogonal to the fibrous direction. For example, if a wooden material is bent around an axis orthogonal to the fibrous direction, mainly a tensile force acts on the wooden fibers, and the wooden material presents a comparatively high strength. However, if the wooden material is bent around an axis parallel to the fibrous direction, the wooden fibers are easily torn apart, the strength is low and cracks are easily brought about.

It is known that a blank plate should be obtained by primarily compressing a wooden material which is an aggregate of wooden fibers, and the blank plate should be further formed by secondarily compressing in order that the wooden fibers may not be torn apart by a tensile force acting among the wooden fibers while being formed.

For example, Japanese Unexamined Patent Application, First Publication No. H08-25301 describes a method for processing a wooden material, in which a plate-shaped primarily fixed article is formed by compressing a square lumber in the direction orthogonal to its fibrous direction and slicing the same, the primarily fixed article is mounted in forming dies with the periphery thereof restricted, and a secondarily fixed article having a three-dimensional shape is obtained by heating the primarily fixed article, causing the same to absorb water, and forming the same.

Also, Japanese Unexamined Patent Application, First Publication No. H11-77619 describes a method for processing a wooden material three dimensionally, in which a wooden material is compressed in a direction orthogonal to the fibrous direction and is sliced to get a wooden plate, which is bent around an axis parallel to the fibrous direction and is temporarily fixed as it is, and three-dimensional forming is carried out with the convex of the bent wooden plate matched to the convex of a press mold.

SUMMARY OF THE INVENTION

A method for producing a formed wooden article according to the invention is a method for producing a formed wooden article by cutting out a primary blank member from a raw wood and forming the same to a final three-dimensional shape having a substantially uniform thickness, which includes:

a primary compression step in which the primary blank member cut out from the raw wood is compressed by primary molding dies having die surfaces with a shape substantially the same as the final three-dimensional shape of the formed wooden article, and the primary blank member is processed into a primary compressed article having a high compression portion formed in a vicinity of portions of the primary blank member corresponding to the die surface with a higher compression ratio than that in a surrounding portion;

a secondary blank processing step in which the primary compressed article is cut and processed into a secondary blank member whose surface keeps a three-dimensional shape transferred onto the high compression portion; and a secondary compression step in which the secondary blank member is compressed by using secondary molding dies and the final three-dimensional shape is transferred onto the secondary blank member.

It is preferable that the method for producing a formed wooden article further include a primary blank forming step for forming a relief portion on the rear side of the portion of the primary blank member when cutting out the primary blank member from the raw wood, where the portion is to be formed to substantially the same shape as the final three-dimensional shape of the formed wooden article.

In the method for producing a formed wooden article according to the invention, it is preferable that the relief portion be formed on the rear side of a portion brought into contact with the bent portion on the die surface of the primary molding die.

In the method for processing a formed wooden article according to the invention, it is preferable that the secondary blank member be cut so that the thickness thereof is made smaller at the portion where the high compression portion is formed to be relatively thick, and is made larger at the portion where the high compression portion is formed to be relatively thin.

In the method for producing a formed wooden article according to the invention, it is preferable that the secondary blank member be cut so that the portion having a thickness in the direction crossing the sliding direction of the secondary molding die is made thinner than the portion having a thickness in the sliding direction of the secondary molding die.

In the method for producing a formed wooden article according to the invention, it is preferable that the formed wooden article finally present a three-dimensional shape having a bottom portion extending in the direction substantially orthogonal to the sliding direction of the secondary molding die and side portions bending from the periphery of the bottom portion toward the sliding direction of the secondary molding die, and that substantially the same shape as that of the side portion be transferred onto the primary blank member through the primary compression step, and the portion onto which substantially the same shape as that of the side portion is transferred, of the primary blank member, be the high compression portion.

DETAILED DESCRIPTION OF THE INVENTION

A description is given for a first embodiment of a method for producing a formed wooden article according to the invention with reference to the accompanying drawings.

Figure 1:
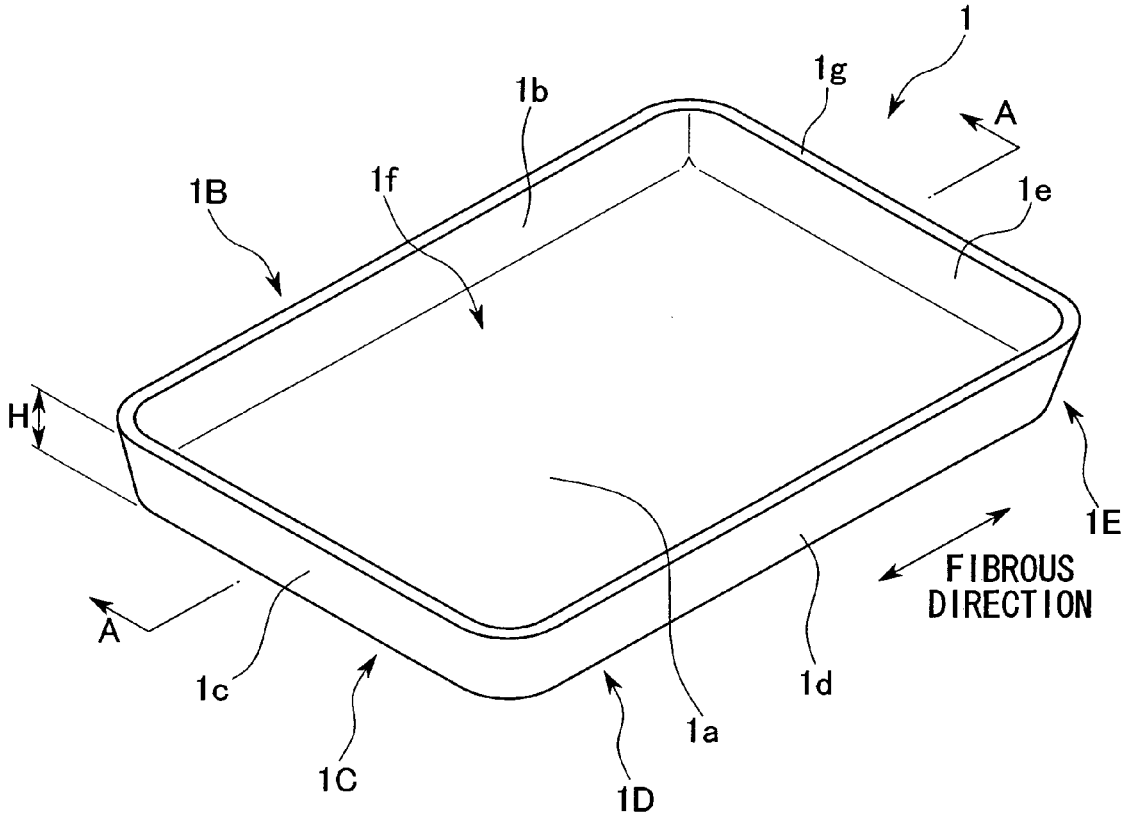
FIG. 1 is a perspective view showing a formed wooden article produced by the method according to a first embodiment of the present invention.
Figure 2:
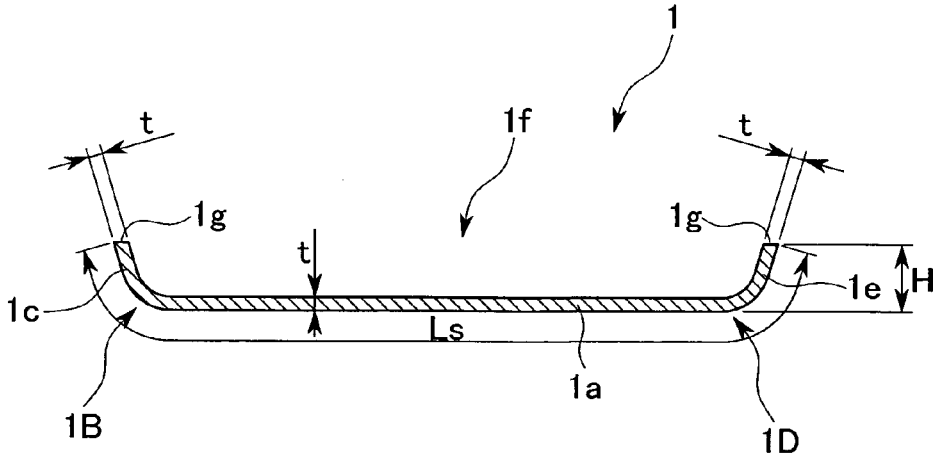
FIG. 2 is a sectional view (taken along line A-A in FIG. 1) showing the formed wooden article produced by the method according to the first embodiment of the present invention.
Figure 3:
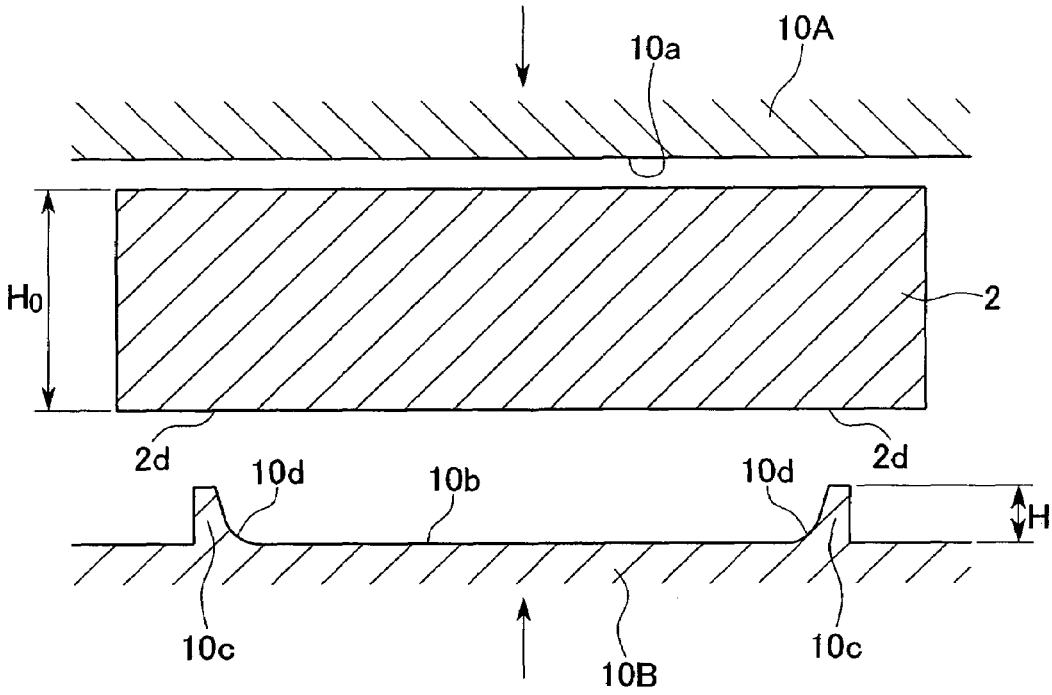
FIG. 3 is a sectional view showing primary molding dies and a primary blank member to be compressed by the primary molding dies, in the primary compression step in the method according to the first embodiment of the present invention.
Figure 4:
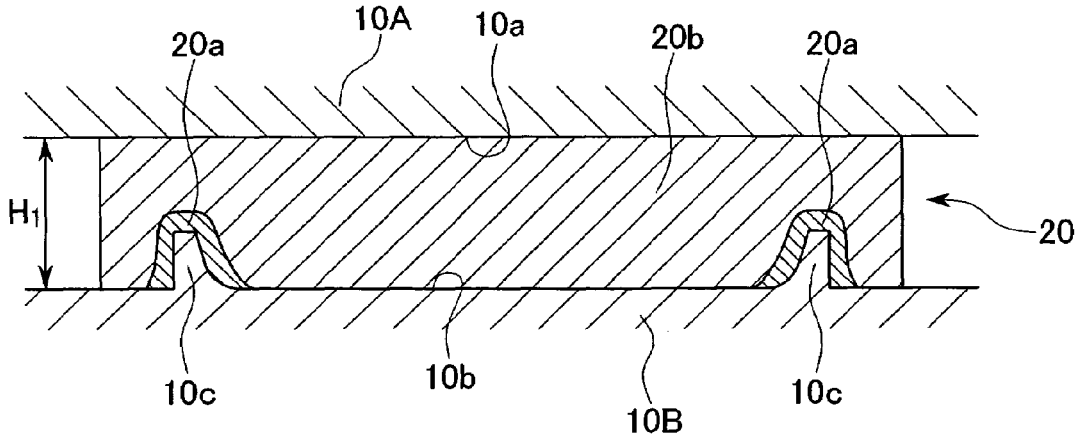
FIG. 4 is a sectional view showing the primary molding dies and the primary blank member compressed by the primary molding dies, which is a primary compressed article, in the primary compression step in the method according to the first embodiment of the present invention.
Figure 5:
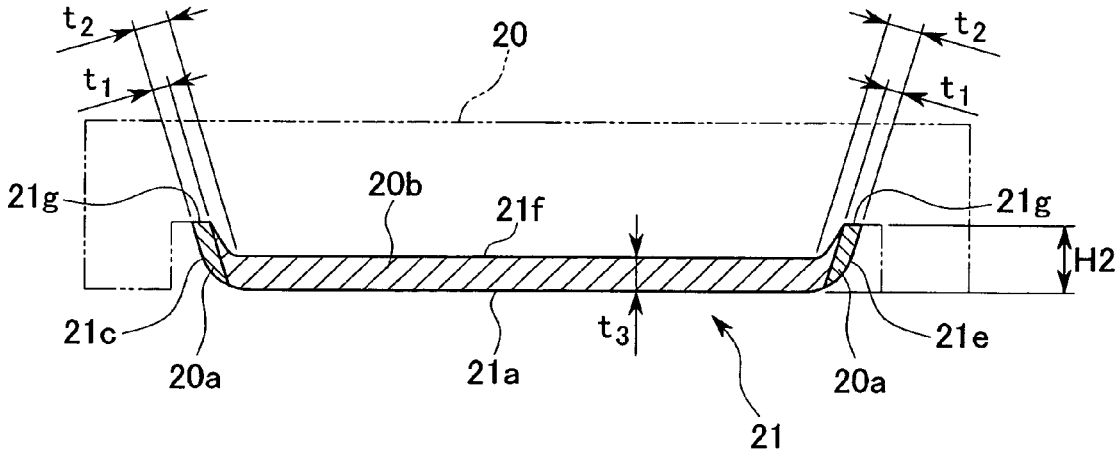
FIG. 5 is a sectional view showing a secondary blank member in the secondary blank processing step in the method according to the first embodiment of the present invention.
Figure 6:
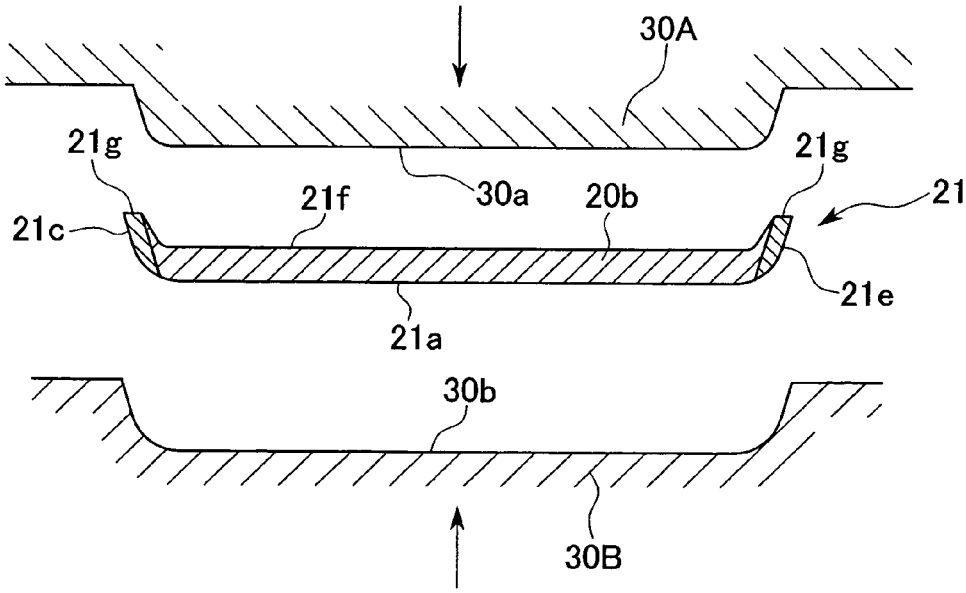
FIG. 6 is a sectional view showing a core molding die, a cavity molding die and a secondary blank member to be compressed by a core molding die and a cavity molding die, in the secondary compression step in the method according to the first embodiment of the present invention.
Figure 7:
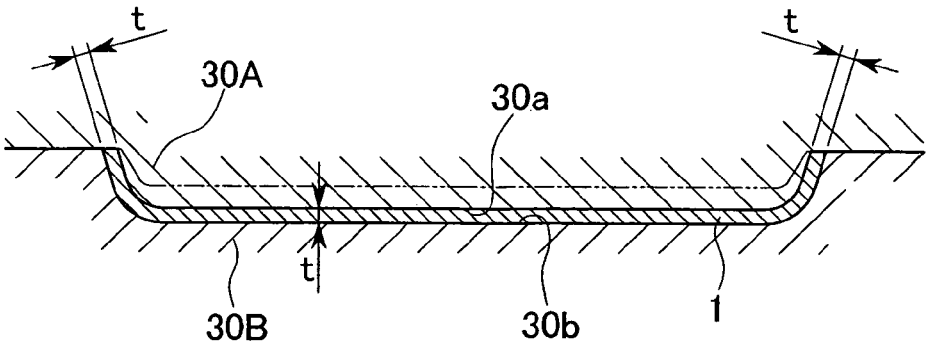
FIG. 7 is a sectional view showing the core molding die, the cavity molding die and the secondary blank member compressed by the core molding die and the cavity molding die, which is a formed wooden article, in the secondary compression step in the method according to the first embodiment of the present invention.

FIG. 1 is a perspective view showing a formed wooden article produced by the method according to the present embodiment. FIG. 2 is a sectional view taken along line A-A in FIG. 1. FIG. 3 is a sectional view showing primary molding die and a primary blank member to be compressed by the primary molding dies in the primary compression step in the method according to the embodiment. FIG. 4 is a sectional view showing the primary molding dies and the primary compressed article compressed in the primary compression step in the method according to the embodiment. FIG. 5 is a sectional view showing a secondary blank member in the secondary blank processing step in the method according to the embodiment. FIG. 6 is a sectional view showing a core molding die, a cavity molding die, and the secondary blank member to be compressed by a core molding die and a cavity molding die in the secondary compression step in the method according to the embodiment. FIG. 7 is a sectional view showing the core molding die, the cavity molding die, and a formed wooden article compressed in the secondary compression step in the method according to the embodiment. Either of the sections shown in FIG. 3 through FIG. 7 is corresponding to the section taken along line A-A in FIG. 1.

The method for producing a formed wooden article according to the present embodiment is a method for producing a three-dimensional structure of high strength, whose thickness is comparatively small and is substantially uniform, for example, a formed wooden article having a structure such as a box, a casing, a container, a cover, a shell-shaped member, etc.

Hereinafter, a description is given of the method, using the formed wooden articles shown in FIG. 1 and FIG. 2 as examples.

A formed wooden article 1 is a box-shaped structure including a bottom portion 1*a* which is rectangular in the plan view, and four side portions 1*b*, 1*c*, 1*d*, and 1*e* erected from respective sides of the bottom portion 1*a* in the direction substantially perpendicular to the bottom portion 1*a*. The formed wooden article 1 has an upper opening 1*f* which is substantially rectangular, and the side portions 1*b*, 1*c*, 1*d* and 1*e* which are slightly inclined outward with respect to the direction perpendicular to the bottom portion 1*a*. In the present embodiment, an opening edge portion 1*g* substantially aligned in the same plane is formed on the upper edges of the side portions 1*b*, 1*c*, 1*d* and 1*e*. Hereinafter, the inside of the upper opening 1*f* is called an "inner surface," and the rear side of the inner surface is called an "outer surface." That is, smoothly bent portions 1B, 1C, 1D and 1E, which are bent by molding dies, are formed on the outer surface side of the ridge portion formed by the bottom portion 1*a* and the side portions 1*b*, 1*c*, 1*d* and 1*e*. Hereinafter, the shape of such a formed wooden article 1 is called a "final three-dimensional shape."

In the embodiment, respective thickness of the bottom portion 1*a* and the side portions 1*b*, 1*c*, 1*d* and 1*e* is denoted as t, and the height from the bottom portion 1*a* of the formed wooden article 1 to the upper opening 1*f* is denoted as H. Herein, H is larger than t. Also, as shown in FIG. 2, the length of the outer surface of the side portion 1*c*, bottom portion 1*a* and side portion 1*e* along line A-A in FIG. 1 is denoted as Ls. Also, all of the bottom portion 1*a* and side portions 1*b*, 1*c*, 1*d* and 1*e* have the same thickness. However, the thickness thereof may differ from each other. As an example of detailed dimensions, for example, t=1.6 mm and H=8.0 mm are preferable. In this case, the height H is five times greater than the thickness t, and the depth of the box-shaped structure is four times greater than the thickness t.

The compression ratio which determines the density after forming is completed is adequately set as necessary. For example, where a formed wooden article is used for a casing, etc., it is preferable that it has substantially uniform strength, and it is preferable that the compression ratio be such that a substantially uniform density can be finally obtained.

Wooden material is composed of wooden fibers having numbers of minute pores, and woodgrains and knots are formed according to the density thereof. That is, wooden material is unevenly constructed when viewed microscopically. Therefore, the term of "density" is used in the embodiment in referring to macroscopic density, and indicates an apparent average density when the wooden material is dried. (This is the same in the following description).

The wooden fiber direction of the formed wooden article 1 in the embodiment is along the lengthwise direction of the side portions 1*b* and 1*d*. A cross grain wood is employed so that changes in the woodgrains on the surface can be easily utilized for design. Also, woodgrains is omitted in FIG. 1 and FIG. 2 in order to avoid complication. However, even if a straight-grained wood is used, formed wooden articles can be produced as in the following description.

There is no special limitation with respect to the species of wooden material. For example, Japanese cypress, Hiba cedar, paulownia, teak, mahogany, Japanese cedar, pine, cherry tree, bamboo, etc., may be preferably employed.

The method for producing a formed wooden article according to the embodiment includes a primary blank forming step, a primary compression step, a secondary blank processing step and a secondary compression step.

In the description below, since the description is given based on the section taken along the line A-A in FIG. 1, no description is given of the side portions 1*b* and 1*d* which do not appear in the sectional view. However, unless otherwise specified, for example, the matters established for the side portions 1*c* and 1*e* can also be established for the side portions 1*b* and 1*d*. Between the side portions 1*c*, 1*e* and 1*b*, 1*d*, there are only a difference in the shape in the width direction and a difference in the orientation with respect to the fibrous direction due to the cutting direction from the raw wood.

The primary blank forming step is for forming a primary blank member to form a primary compressed article. In the embodiment, a block-shaped primary blank member 2 whose area is wider than a formed wooden article 1 in its plan view, and whose thickness is larger than the height H of the formed wooden article 1 is cut out from a raw material.

As shown in FIG. 3 and FIG. 4, in the primary compression step, the primary blank member 2 is formed using primary molding dies 10A and 10B, and a primary compressed article 20 a part of whose formed surfaces has a shape substantially the same as the final three-dimensional shape of the formed wooden article 1.

The primary blank member 2 is set between the primary molding dies 10A and 10B. A die surface having a shape coincident with a part of the final three-dimensional shape is formed on at least one of the primary molding dies 10A and 10B.

As shown in FIG. 3, in the embodiment, the primary molding dies 10A and 10B are caused to slide in the vertical direction to compress the primary blank member 2 in the vertical direction. At this time, pressurized water vapor whose temperature is, for example, 120° C. through 200° C. is jetted toward the primary blank member 2 in order to soften the same. Alternatively the primary blank member 2 may be warmed in hot water, whose temperature is 40° C. or more, for a predetermined period of time, and thereafter may be compressed in a pressurized environment of a temperature of 120° C. to 200° C. At this time, it is preferable that the primary molding dies 10A and 10B be heated to an equivalent temperature to the above.

Next, as shown in FIG. 4, a clamped state is maintained until the shape of the die surface is transferred onto the primary blank member 2 and fixed thereon. Further, the clamped state is held for a predetermined period of time and the primary blank member 2 is released from the molding dies after drying.

In the embodiment, the die surface 10*a* of the primary molding die 10A is formed to be substantially flat, so that it may push the upper surface of the primary blank member 2, and the upper surface of the primary blank member 2 may be easy to move along the die surface 10*a* while being compressed. On the other hand, the die surface 10*b* of the primary molding die is provided with protrusion portions 10*c* which are rectangular in the plan view and are caused to protrude from the die base, and a three-dimensional shape to meet the outer surface side of the final three-dimensional shape is formed at the middle of inside the protrusion portion. Inner curved portions 10*d* each having a curved surface, which have substantially the same curvature as that of the bent portions 1B, 1C, 1D and 1E, are formed with respect to the bent portions 1B, 1C, 1D and 1E on the die surface 10*b*, whereby the bent forming portion 2*d* may be curved along the inner curved portions 10*d*.

When compression is carried out, the lower surface 2*a* of the primary blank member 2 is compressed along the three-dimensional shape of the die surface 10*b*. At this time, the compressive force is transmitted in the thickness direction of the primary blank member 2 and is further transferred to the die surface 10*a* dispersively. Therefore, the primary blank member 2 is given uneven compressive forces at respective parts thereof on the basis of the shapes of the die surface 10*b* and protrusion portion 10*c*.

In the present step, since the wooden fibers are softened by high temperature water vapor, the primary blank member 2 is easily subjected to deformation through compression. Therefore, the deformation based on compression advances at a portion which receives a large compressive force from the die surface 10*b*, for example, in the vicinity of the protrusion portion 10*c*, and a high compression portion 20*a* whose density is higher than that of the surrounding parts thereof is formed. Thus, since the compressive force is reduced when the high compression portion 20*a* is formed, a low compression portion 20*b* whose density is lower than that of the high compression portion 20*a* is formed in line with distance from the protrusion portion 10*c*. Accordingly, as shown in FIG. 4, no high compression portion 20*a* is generated, except for in the vicinity of the protrusion portion 10*c*, at portions along the die surface 10*b* corresponding to the outer surface of the bottom portion 1*a* of the formed wooden article 1. As shown in FIG. 4, at a portion far from the protrusion portion 10*c*, the primary blank member 2 having a thickness $H_0$ is subjected to compression at a substantially uniform compression ratio so that the thickness becomes substantially $H_1$ (here, $H_1<H_0$). Herein, it is preferable that the thickness $H_1$ be about two-thirds the thickness $H_0$. That is, it is preferable that the compression ratio of the relative low compression portion is 33% or so.

Herein, a difference in the density between the high compression portion 20*a* and the low compression portion 20*b* is relative. The high compression portion 20*a* is set so that the density thereof does not exceed at least the density required for the formed wooden article 1. Where there is any portion whose density may exceed the density required for the formed wooden article 1, a relief of a adequate shape may be provided on the die surface 10*a* corresponding to such a portion.

Thus, since in the primary compression step only a part of the final three-dimensional shape of the formed wooden article 1 is formed substantially according to the shape thereof, the compression resistance is weak and it is possible to easily carry out compression even with a comparatively small pressing force. In addition, since the low compression portion 20*b* is formed at a great majority part adjacent to the die surface 10*b* although the high compression portion 20*a* is formed in the vicinity of the protrusion portion 10*c*, deformation load on the high compression portion 20*a* is reduced, and it is possible to prevent wooden fibers from being torn and to prevent the formed wooden article from being rubbed against the die surface in comparison with the case where the primary blank member is placed between the molding dies 10A and 10B and receives uniform compression to form only high compression portion 20*a*.

The primary molding dies 10A and 10B slide only in one direction and may have the die surfaces only a part of which must be highly accurate and complicated in shape. Therefore, the primary molding dies 10A and 10B are very simple.

As shown in FIG. 5, in the secondary blank processing step all other portions of the primary compressed article 20 are cut off while leaving the primary formed surface 21*a* of the bottom portion and the primary formed surfaces 21*c* and 21*e* of the side portion, onto which the die surface 10*b* is transferred, and a secondary blank member 21 to be compressed by using secondary molding die described later is formed.

The secondary blank member 21 is formed in such a way that there are cut off the outside of the bent forming portion 2*d* and the portion brought into contact with the die surface 10*a*, a portion of a height $H_2$ from the primary formed surface 21*a* of the bottom portion is left over, and an opening side edge 21*g* is formed in the remaining portion, and a concave cut surface 21*f* is formed inside the opening side edge 21*g*. In FIG. 5, the cut-off portions are shown by virtual lines.

Thus, the secondary blank member 21 is a box-shaped structure having an opening like a formed wooden article 1. The outer surface of the secondary blank member 21 is substantially the same as the final three-dimensional shape of the formed wooden article 1, and the cut surface 21*f* is formed inside the secondary blank member 21.

The cut surface 21*f* is cut so that the thickness of the secondary blank member 21 is made smaller at the portion where the high compression portion 20*a* is formed to be thick, and the thickness of the secondary blank member 21 is made larger at the portion where the high compression portion 20*a* is formed to be thin. Here, each portion is referred to as being thin even when the thickness is zero. For example, as shown in FIG. 5, since the high compression portion 20*a* is not formed on the bottom of the secondary blank member 21, the thickness thereof from the primary formed surface 21*a* of the bottom portion is set to a thickness t3 which is the largest (here, t3>t). At the side portions of the secondary blank member 21, since the thickness of the high compression portion 20*a* is gradually increased from the primary formed surface 21*a* of the bottom portion toward the opening side edge 21*g*, the secondary blank member 21 is cut so that the side portion has a thickness t1 (here, t3>t1≧t) at the opening side edge 21*g* and has a thickness t2 (here t3≧t2>t1) in the vicinity of the bottom portion of the cut surface 21*f*. In the embodiment, since almost whole side portion is formed into the high compression portion 20*a* in the vicinity of the opening side edge 21*g*, the thickness t1 is made equal to t (t1=t), or the compression ratio is established so as not to exceed a so-called critical compression ratio at which pores of wooden material are completely closed in the secondary compression and further compression becomes impossible, in the other case where the thickness t1 is larger than t (t1>t).

Thus, the side portions of the cut surface 21*f* are more gently inclined from the opening side edge 21*g* toward the bottom portion than the primary formed surfaces 21*c* and 21*e* of the side portion. Although the high compression portion 20*a* gradually increases in thickness toward the opening side edge 21*g*, the low compression portion 20*b* gradually decreases in thickness toward the opening side edge 21*g* at the side portions of the secondary blank member 21.

It is preferable that dimensions such as the thickness t1, t2 and t3, that is, a shape of the cut surface 21*f* to be processed be set so as to obtain a density required for a formed wooden article 1 after the secondary compression step, after finding the density distributions of the high compression portion 20*a* and the low compression portion 20*b*, which are formed in the primary compression step through, for example, experiments or numerical simulations. That is, an amount of shortage in the thickness and density of the high compression portion 20*a* is investigated with respect to required thickness t and density ρ for the formed wooden article 1, and the shape of the cut surface 21*f* is set so that the low compression portion 20*b* is left over to compensate the amount of shortage.

Therefore, the density of the formed wooden article 1 may be made uniform or varied by setting the shape of the cut surface 21*f*. Also, the density distributions after compression of a wooden material cause the coloring distribution on the surface to appear. Therefore, in use in which the appearance should be important, it is preferable that unevenness in the density is minimized.

Further, from the viewpoint of reducing the compression resistance during the secondary compression, it is preferable that the cut surface 21*f* be set so that the thickness is made thin at the side portion of the secondary blank member 21 crossing at a slight angle with the sliding direction of the secondary molding dies.

As shown in FIG. 6 and FIG. 7, in the secondary compression step a secondary blank member 21 is compressed by using a core molding die 30A and a cavity molding die 30B (both of which are the secondary molding dies) to form a formed wooden article 1. Die surfaces 30*a* and 30*b*, which are finished into a shape to transfer the final three-dimensional shape, are formed on the core molding die 30A and the cavity molding die 30B, respectively, in order to form the formed wooden article 1.

First, the secondary blank member 21 is set so that the primary formed surface 21*a* of the bottom portion thereof and the primary formed surfaces 21*c* and 21*e* of the side portion thereof may be fitted to the die surface 30*b*, and the cut surface 21*f* may face the die surface 30*a*. As shown in FIG. 6, the core molding die 30A and the cavity molding die 30B are caused to slide in one direction to compress the secondary blank member 21 in the vertical direction. At this time, pressurized water vapor whose temperature is, for example, 120° C. through 200° C. is jetted toward the secondary blank member 21 in order to soften the same. Alternatively, the secondary blank member 21 may be warmed in hot water, whose temperature is 40° C. or more, for a predetermined period of time, and thereafter may be compressed in a pressurized environment of a temperature of 120° C. to 200° C. At this time, it is preferable that the core molding die 30A and the cavity molding die 30B be heated to an equivalent temperature to the above.

Next, as shown in FIG. 7, a clamped state is maintained until the shape of the die surface is transferred onto the secondary blank member 21 and fixed thereon. Further, the clamped state is held for a predetermined period of time, and the secondary blank member 21 is released from the molding dies after drying. Through the step, a formed wooden article 1 is formed by the compression of the secondary blank member 21. That is, by the compression of the bottom portion of the cut surface 21*f* of the secondary blank member 21, the bottom portion 1*a* of the formed wooden article 1 is formed to have a thickness made smaller from t3 to t, and by the compression of the side portion of the cut portion 21*f*, the side portions 1*b*, 1*c*, 1*d* and 1*e* are formed to have thicknesses made smaller from t1 through t2 to t.

A description is given of operations of the present step.

Figure 8:
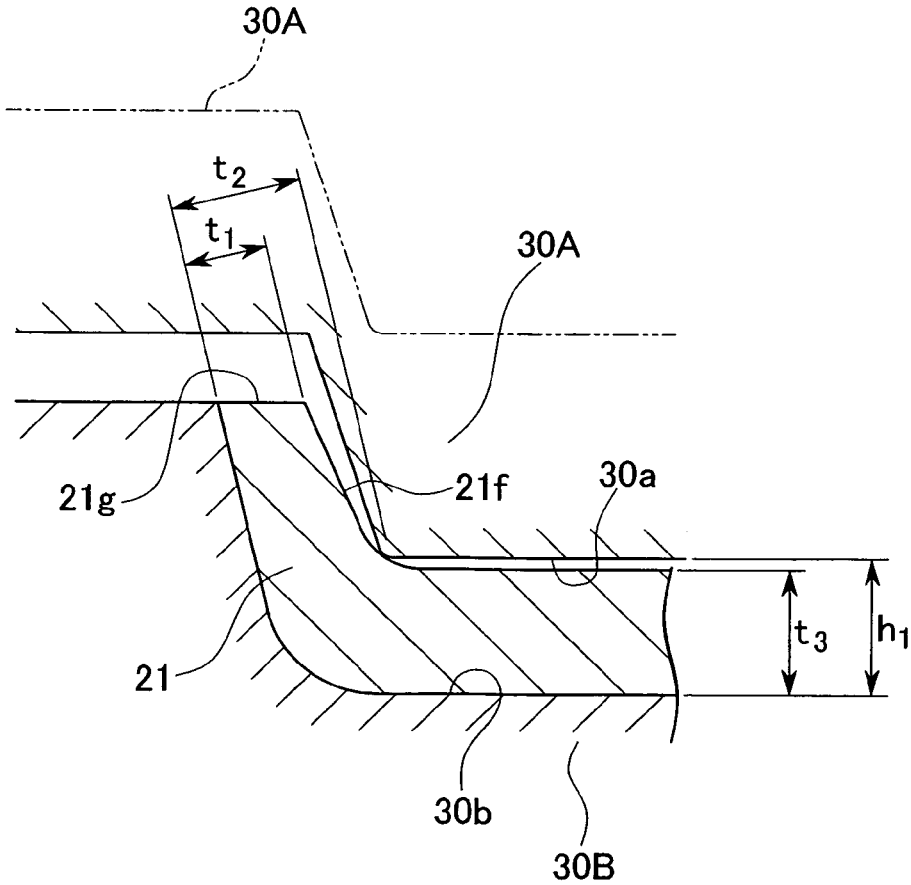
FIG. 8 is a sectional view for explaining functions of the secondary compression step in the method according to the first embodiment of the present invention.
Figure 9:
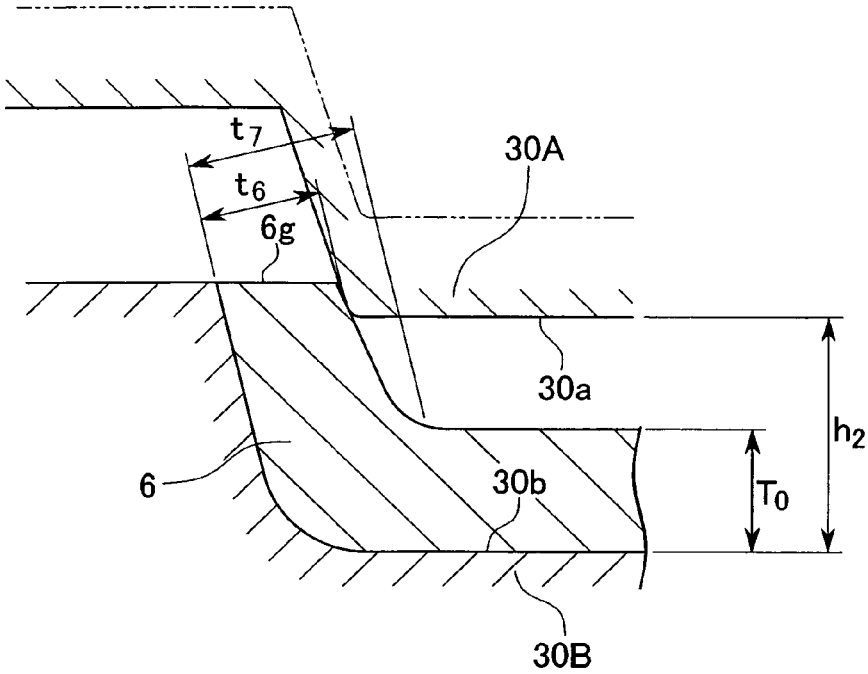
FIG. 9 is a sectional view for explaining functions of compression steps in a conventional method for producing a formed wooden article.
Figure 10:
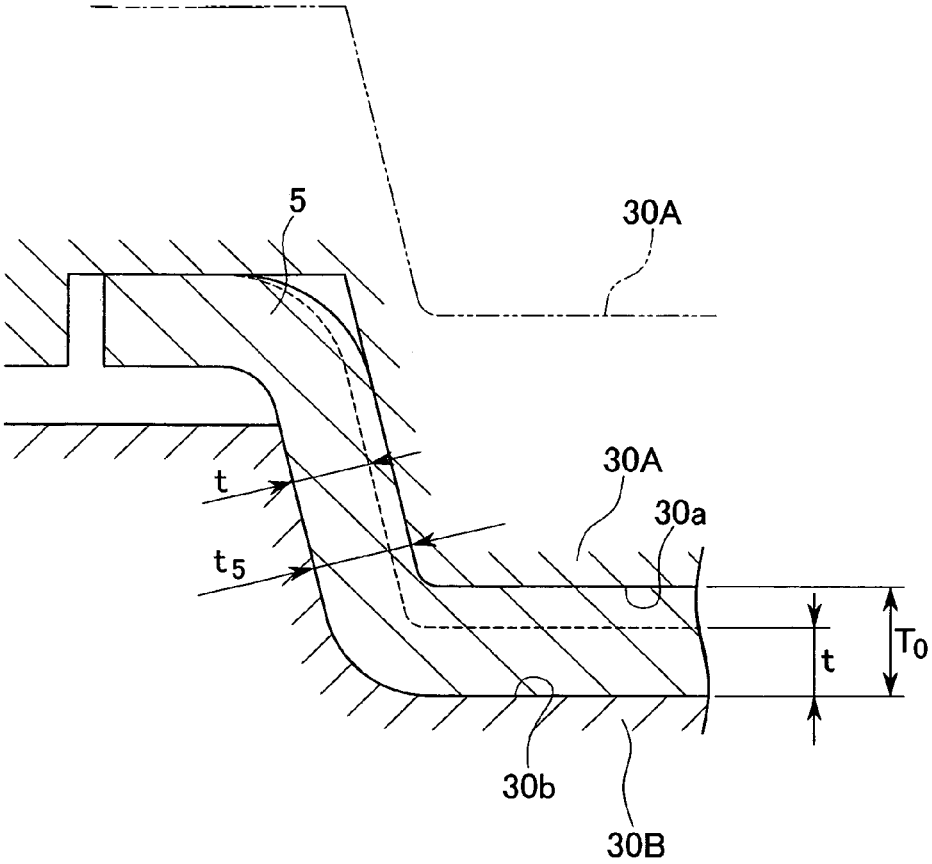
FIG. 10 also is a sectional view for explaining functions of a compression step in the conventional method for producing a formed wooden article.

FIG. 8 is a sectional view describing operations of the secondary compression step according to the embodiment. FIG. 9 and FIG. 10 are sectional views describing operations of a compression step in a prior art method for producing formed wooden articles. FIG. 8 through FIG. 10 are enlarged views of the major parts of the section corresponding to the A-A section in FIG. 1.

As shown in FIG. 8, since, in the step, the side portion of the cut surface 21*f* of the secondary blank member 21 is gently inclined from the opening side edge 21*g* to the bottom portion when the core molding die 30A is lowered so that the die surface 30*a* may be below the opening side edge 21*g* and higher than the die surface 30*b* by $h_1$ (here, $h_1$>t3), it begins to be in contact with the secondary blank member 21. As the core molding die 30A further slides, at the side portion of the cut surface 21*f*, the side surface of the die surface 30*a* gradually compresses the secondary blank member 21 from the front edge of the die surface 30*a*, that is, from the bottom portion of the side surface of the cut surface 21*f*, and the vicinity of the opening side edge 21*g* is finally compressed.

In addition, at the bottom portion of the cut surface 21*f*, compression proceeds on the entirety of the bottom portion after the die surface 30*a* is higher than the die surface 30*b* by t3 or less.

Also, since the outer surface of the secondary blank member 21 such as the primary formed surface 21*a* of the bottom portion and the primary formed surfaces 21*c* of the side portion has a three-dimensional shape meeting the die surface 30*b*, the outer surface is subjected to a compressive force in the direction perpendicular to the respective surfaces of the molding dies and is compressed into a shape which completely meets the die surface 30*b*. However, the outer surface does not substantially slide in the direction along the die surface 30*b*. Therefore, substantially no rubbing against the die surface 30*b* occurs.

Further, the entirety of the secondary blank member 21 is partially compressed in the primary compression step, the compression amount required in the secondary compression step is lowered by the amount of which the primary formed surface 21*a* of the bottom portion and the primary formed surface 21*c* of the side portion have already been compressed. As a result, since the compression resistance is made small, it is easy to compress the secondary blank member 21 even if the pressing force is weak.

In contrast, in a case where a formed wooden article of a three-dimensional shape having the bottom portion and the side portions as in the present embodiment is produced by a prior art method for producing a formed wooden article, the following problems are brought about.

First, as shown in FIG. 9, a description is given of a case of using a three-dimensional blank 6 which is obtained by cutting a wooden material into the shape of slightly larger size than the shape after the compression forming. Even in the case where the three-dimensional blank 6 is not primarily compressed or where it is cut from an evenly primarily compressed member, the thickness of the three-dimensional blank 6 is made larger than in the above-described embodiment. For example, where it is assumed that the thickness of the bottom portion is TO, and the thicknesses of the side portions are, respectively, t6 and t7, the following expressions of TO≧t3, t6>t1 and t7≧t2 are desired.

In the prior art producing method described above, since a three-dimensional blank 6 is three-dimensionally cut, production thereof is made cumbersome. Further, when compressing the three-dimensional blank 6 by using the core molding die 30A and the cavity molding die 30B, the compression ratio is made larger than that in the embodiment. Thus, it becomes necessary to prepare a large pressing force that can meet the compression ratio.

Also, the molding die 30*a* begins to be in contact with the three-dimensional blank 6 at a position which is higher than the die surface 30*b* by h2 (here, h2>h1), which is nearer to the opening side edge 6*g* than in the above-described embodiment. Therefore, the side portion precedes in being compressed, whereby the bottom portion is compressed with the surrounding portion restricted and with no relief being secured in the surrounding portion. Resultantly, friction between the side portion and the molding dies is increased, and the compression ratio at the bottom portion is made uneven, thereby resulting in deterioration of the appearance of a formed wooden article.

Next, a description is given of a method for producing a formed wooden article of the same shape from a blank board 5.

As shown in FIG. 10, when compressing the blank board 5 by using the core molding die 30A and the cavity molding die 30B, first, the blank board 5 is bent while bringing the front edge of the die surface 30*a* into contact with the blank board 5. At this time, cracks are apt to occur at the bent portions. In molding dies for forming to make the thickness uniform, the distance between the die surfaces inclined against the sliding direction is narrowed faster than the distance between the die surfaces orthogonal to the sliding direction. Therefore, as the molding dies slide, the compression at the side portion precedes the compression at the bottom portion. For example, in FIG. 9, where it is assumed that the thickness of the side portion is t5 and the thickness of the bottom portion is T0, t5 is smaller than T0 in the compression step. Therefore, before the bottom portion is sufficiently compressed, large compression resistance is generated at the side portion, and the side portion precedes in being compressed. The bottom portion is compressed with the surrounding portion restricted, wherein the side portion and the bottom portion are compressed while being remarkably pulled by each other. As a result, rubbing against the molding dies is increased at the side portion, and at the same time, the compression ratio at the bottom portion is made uneven, thereby resulting in deterioration of the appearance of the formed wooden article.

As described above, according to the producing method of the above-described embodiment, since the compression step is carried out with the same divided into two steps, it is easy to compress and form a wooden material even with a smaller pressing force than that in the prior art method for producing a formed wooden article, which is described above.

Further, since, in the primary compression step, a wooden material is compressed from a non-compressed state in the situation where the compression resistance is low, and a part of the three-dimensional shape is formed, it becomes possible to form a high-quality compressed surface on the secondary blank member, and simultaneously possible to reduce the amount of cutting of the secondary blank member. Therefore, the secondary blank member can be easily processed.

Also, it is preferable that the primary compression step and the secondary compression step are carried out, for example, with the core molding die 30A and the cavity molding die 30B installed in a high-pressure vessel, whereby the compression can be efficiently carried out.

In the above description, the primary molding die 10B used in the primary compression step and the cavity molding die 30B used in the secondary compression step are separately provided. However, where the shape of the die surface 10*b* of the primary molding die 10B is identical to the final three-dimensional shape of a formed wooden article 1, the primary molding die 10B may be concurrently used as a cavity molding die used in the secondary compression step.

In the above description, an example, in which a part of the three-dimensional shape of a formed wooden article is formed only on the outer surface of the primary compressed article in the primary compression step, is described. However, if a portion whose compression surface is required to be finished with high quality is on the inner surface side of the primary compressed article, a three-dimensional shape which is left over in the secondary compression step may be also formed on the inner surface of the primary compressed article. In addition, the three-dimensional shape may be formed only on the inner surface side.

In the above description, an example was described, in which the primary compressed article is cut with a part of a three-dimensional shape formed in the primary compression step wholly left over in the secondary blank processing step. However, as long as the secondary blank member has a thickness for which re-compression is feasible, a part of the three-dimensional shape formed in the primary compression step may be cut. For example, the three-dimensional shape formed on the primary molding dies is made into a slightly large and approximate three-dimensional shape which can be easily produced, and a part of the primary compressed article is cut in the secondary blank processing step, wherein the compression ratio and shape may be adjusted.

The above description describes an example which is provided with two compression steps. However, another compression step may be provided as necessary. For example, a zero-order compression step may be added as a pre-process of the primary compression step, wherein uneven shape is simply formed on a block-shaped primary blank member cut out from the raw wood, and the shape according to the final three-dimensional shape is not formed. Thus, for example, in a case where a primary compressed article having a complicated shape is formed, the shape of the primary blank member may be formed so as to further reduce a forming load in the primary compression step.

The above description describes an example of a rectangular solid block member. However, the shape of the primary blank member is not limited thereto. The shape may be adequately altered in compliance with the shape of a formed wooden article. For example, various shapes such as a cylindrical shape, semi-spherical shape, a conical shape, etc., may be employed. For example, curved surface shapes of the portions formed in the primary blank member in the above description are provided corresponding to the curved surface shapes of the respective portions of a formed wooden article according to the embodiment.

A description is given of a second embodiment of a method for producing a formed wooden article according to the invention with reference to the drawings. Hereinafter, a description is given mainly of points differing from the first embodiment.

A formed wooden article produced by the method for producing the formed wooden article according to the present embodiment is similar to the formed wooden article 1 in the first embodiment shown in FIG. 1 and FIG. 2.

Figure 11:
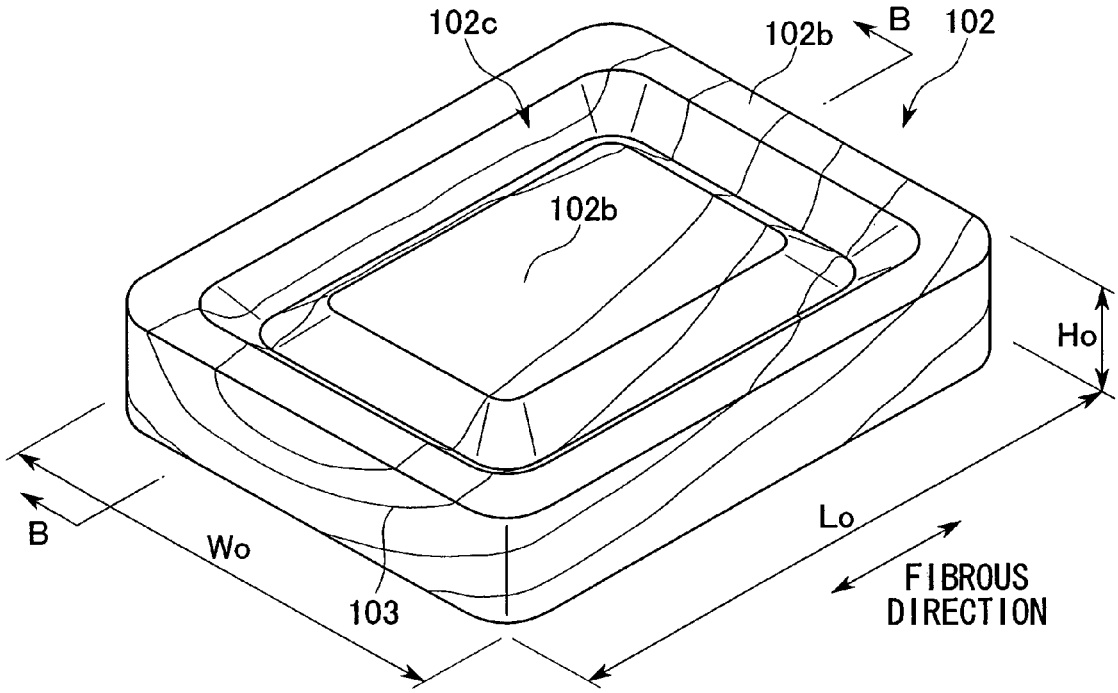
FIG. 11 is a perspective view showing a primary blank member formed in the primary blank forming step in the method according to a second embodiment of the present invention, when being observed from the rear side of the formed surface thereof.
Figure 12:
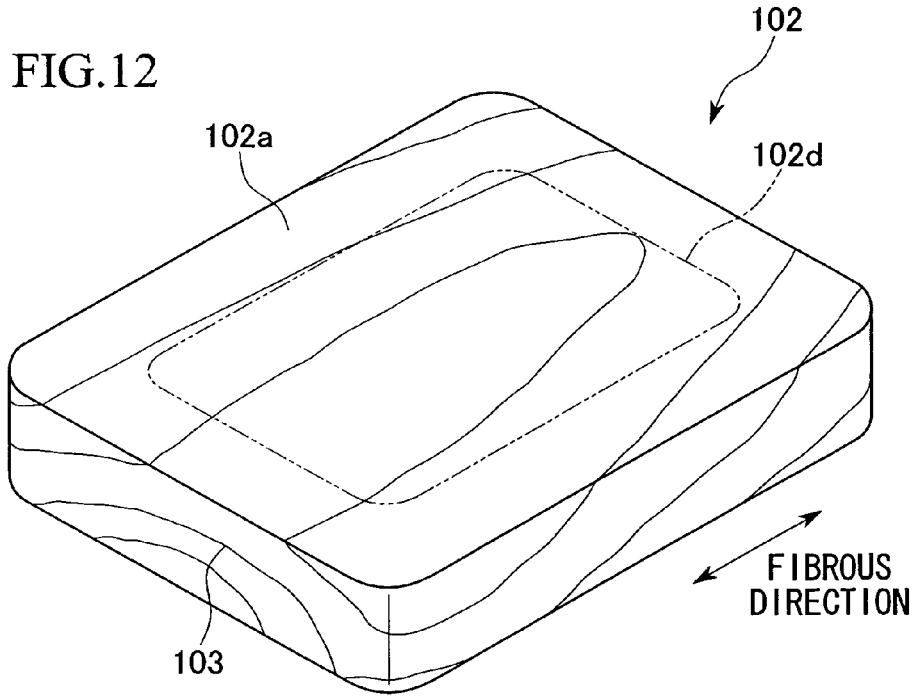
FIG. 12 is a perspective view showing the primary blank member formed in the primary blank forming step in the method according to the second embodiment of the present invention, when being observed from the front side of the formed surface thereof.
Figure 13:
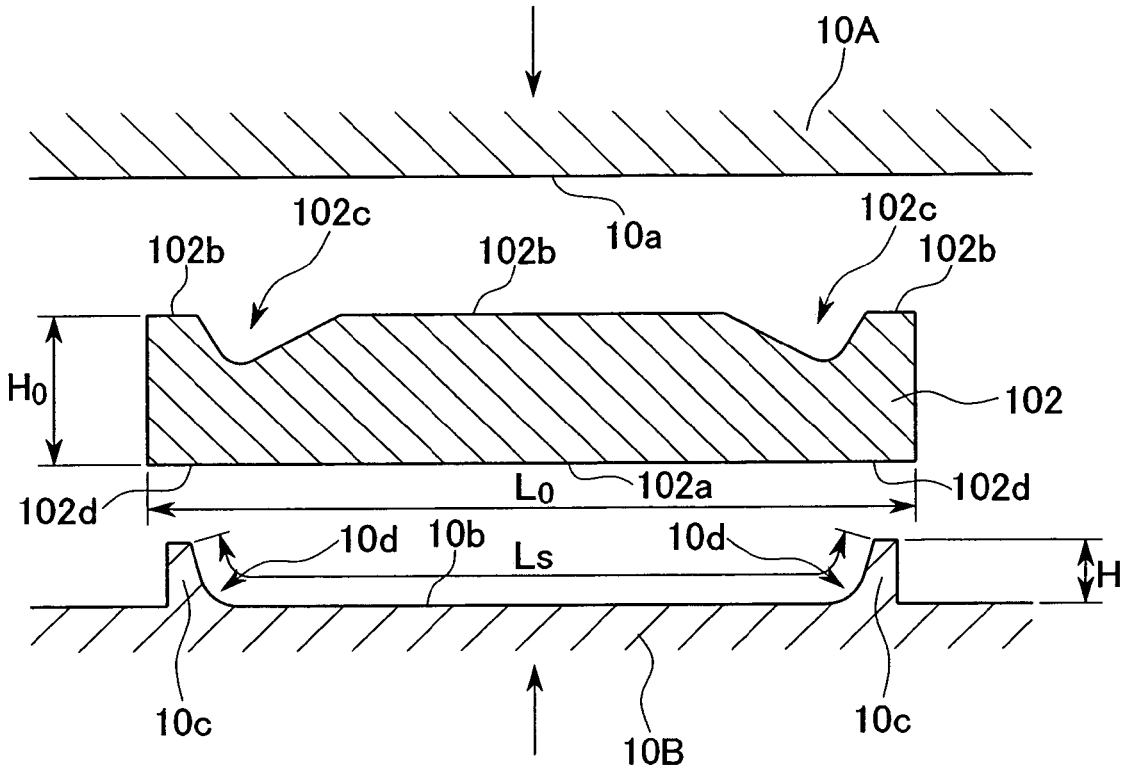
FIG. 13 is a sectional view showing the primary molding dies and the primary blank member to be compressed by the primary molding dies, in the primary compression step in the method according to the second embodiment of the present invention.
Figure 14:
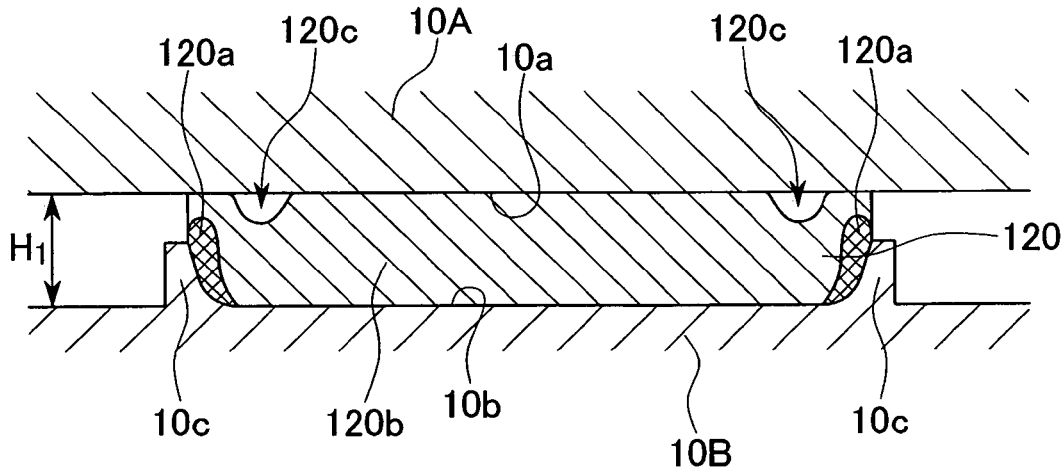
FIG. 14 is a sectional view showing the primary molding dies and the primary blank member compressed by the primary molding dies, which is a primary compressed article, in the primary compression step in the method according to the second embodiment of the present invention.
Figure 15:
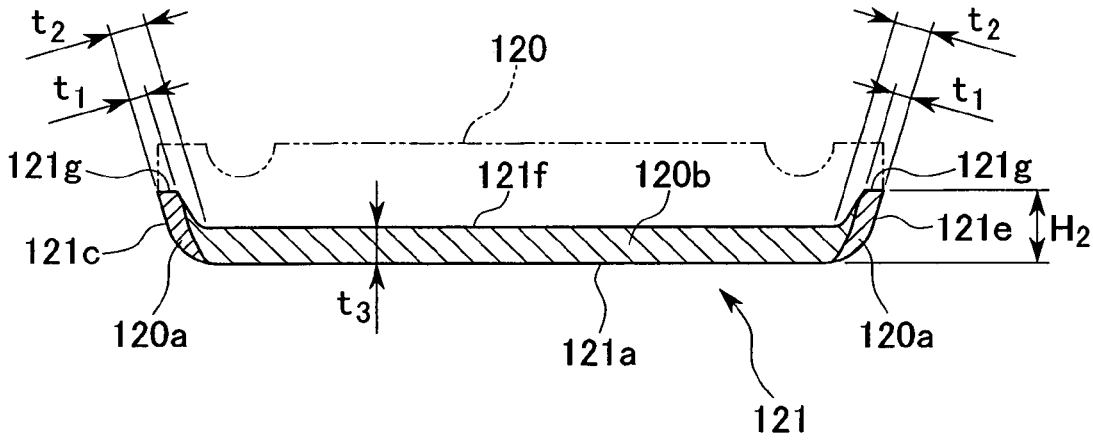
FIG. 15 is a sectional view showing a secondary blank member in the secondary blank processing step in the method according to the second embodiment of the present invention.

FIG. 11 is a perspective view of a primary blank member formed in the primary blank forming step in the method according to the embodiment when being viewed from the rear side of its formed surface. FIG. 12 is a perspective view of a primary blank member formed in the primary blank forming step in the method according to the embodiment when being viewed from the front side of its formed surface. FIG. 13 is a sectional view showing the primary molding dies and a primary blank member in the primary compression step in the method according to the embodiment. FIG. 14 is a sectional view showing the primary molding dies and a primary compressed article compressed in the primary compression step in the method according to the embodiment. FIG. 15 is a sectional view showing a secondary blank member in the secondary blank processing step in the method according to the embodiment. The sections shown in FIG. 13 through FIG. 15 correspond to the section taken along line A-A of FIG. 1.

As shown in FIG. 11 and FIG. 12, a primary blank member 102 of the embodiment is such that a rectangular solid block member whose length is LO, width is WO and height is $H_0$ is cut out from a base material whose thickness is $H_0$ or more, and a V-shaped groove-like relief portion 102*c* (relief for primary compression) is formed on the rear side 102*b* of the surface 102*a* that forms the outer surface of a formed wooden article 1 in the primary blank forming step. The surface 102*a* is cut to be flat along the direction of wooden fibers. Woodgrains 103 appear on the surface 102*a*. The length LO is set substantially the same as or longer than the total length of the outer surface of the side portion 1*c*, bottom portion 1*a* and side portion 1*e* of the formed wooden article 1, and the width WO is set substantially the same as or longer than the total length of the outer surface of the side portion 1*b*, bottom portion 1*a*, and side portion 1*d* thereof. For example, the length LO is set substantially the same as the length Ls in FIG. 2 or longer than Ls.

Here, the length which is "substantially the same as or longer than the length of the outer surface" means a length by which the surface 102*a* can form the outer surface of the formed wooden article 1. For example, a case where the length LO becomes equal to or more than LS through elongation brought about by absorption of water or a tensile force even if the length LO is initially shorter than LS, and a case where the length LO is slightly larger than Ls so that an extra length can be cut later, is included.

The relief portion 102*c* is provided to reduce a forming load when primarily compressing the primary blank member 102. The relief portion 102*c* is formed on the rear side of the primary blank member 102, as shown in FIG. 13, by cutting a groove with, for example, substantially V-shaped section. The relief portion 102*c* is formed at an appropriate point and in an appropriate size, so that the formed surface of the primary blank member is not excessively pulled when the primary compression is carried out using primary molding dies described later. In the embodiment, the surface 102*a* of the primary blank member 102 is formed, by the primary molding dies, to substantially the same shape as bent portions 1B, 1C, 1D and 1E so that the shape of the surface becomes substantially the same as the final three-dimensional shape.

Therefore, as shown in FIG. 12, the relief portion 102*c* is provided on the rear side of the bending-forming portions 102*d* corresponding to these bent portions 1B, 1C, 1D and 1E.

Since, in the primary compression step, wooden fibers are softened by high temperature water vapor, the primary blank member 102 is easily subjected to deformation through compression. Therefore, the deformation based on compression may advance at a portion, which receives a large compressive force from the die surface 10*b*, of the primary blank member 102, for example, in the vicinity of the protrusion portion 10*c*, and as shown in FIG. 14, a high compression portion 120*a* whose density is higher than that of its surrounding part is formed. On the other hand, the relief portion 102*c* is compressed by its surrounding and its capacity is reduced, and it is deformed into a groove portion 120*c*. Therefore, the compression ratio is relieved in the vicinity of the relief portion 102*c* in comparison with a case where no relief portion 102*c* is provided. Accordingly, it is possible to prevent an excessive compressive force from being generated by the protrusion portion 10*c*. It is therefore possible to prevent the compression ratio of the high compression portion 120*a* from exceeding a so-called critical compression ratio at which pores of a wooden material are completely closed and further compression becomes impossible.

Here, the high compression portion 120*a* is set so that the density thereof does not exceed at least the density required for the formed wooden article 1. If there is any portion whose density may exceed the density required for the formed wooden article 1, it is favorable, for example, that the size and shape of the relief portion 102*c* are adequately established, or a relief of an adequate shape is provided on the die surface 10*a* corresponding to such a portion.

Thus, since in the primary compression step, only a part of the final three-dimensional shape of the formed wooden article 1 is formed substantially according to the shape thereof, the compression resistance is weak and it is possible to easily carry out compression even with a comparatively small pressing force. In addition, although, at the inner curved portion 10*d*, the primary blank member 102 is bent and the density is liable to increase, it is possible to lower the density of the high compression portion 20*a* in comparison with a case where no relief portion 102*c* is provided, because the relief portion 102*c* is provided on the rear side of the bending forming portion 102*d*. Therefore, the tensile force at the bending forming portion 102*d* can be lowered, and it is possible to prevent the formed surface from tensile deformation and to prevent wooden fibers from being torn.

Here, with respect to the primary formed surface 121*a* of the bottom portion, and the primary formed surfaces 121*c* and 121*e* of the side portion, the surface 102*a* of the primary blank member 102 is formed into the surface along the direction of wooden fibers with the length of the surface 102*a* substantially unchanged, whereby the wooden fibers exposed on the surface are not cut, and the surface 102*a* is formed in compliance with the three-dimensional shape of the die surface 10*b*. Accordingly, the woodgrains 103 of the surface 102*a* are not substantially disordered by influence due to a compressive force and a tensile force, or by cut traces. Further, the appearance is not spoiled by the fuzz due to rubbing against the die surface 10*b* whereby primary compression is carried out with satisfactory appearance secured.

In the secondary blank processing step, the cut surface 121*f* is more deeply engraved than the depth of the groove portion 120*c* so that the groove portion 120*c* is not exposed to the surface of the formed article. Therefore, the cut surface 121*f* is turned into a smooth cut surface without any groove left.

As described above, with the producing method according to the embodiment, since the primary blank member 102 having a relief portion 102*c* formed on the rear side of the portion where a bent portion is formed is brought into contact with the die surface 10*b* having a part of the final three-dimensional shape of a formed wooden article formed, the compressive force on the rear side of the primary blank member 102 can be reduced, and no excessive tensile force is generated on the surface brought into contact with the die surface. Therefore, since the formed surface of the primary compressed article 120 is not excessively elongated and torn, and is not rubbed against the die surface, a formed surface having excellent appearance can be obtained.

Also, the relief portion 102*c* of the primary blank member 102 is provided on the outer surface corresponding to the bent portion according to the unevenness of the three-dimensional shape on the inner surface, wherein, for example, when a concavity of a formed article is formed on the inner surface, the relief portion 102*c* formed on the outer surface is subjected to a tensile force and is widened when the primary compression is carried out. Therefore, the compressive force on the inner surface is relieved. In addition, even if the relief portion 102*c* is closed up, the density can be lowered in comparison with a case where no relief portion is provided.

In the above description, in the primary blank forming step, a description was given of an example in which a groove relief portion 102*c* is provided whose section is substantially V-shaped. However, in order to make deformation of the bent portion easy and to make the density of the primary compressed article adequate, it is preferable that the size and shape of the groove portion be adequately established. For example, it is preferable that a relief portion 102*c* provided at the bent portions at four corners, where the bottom portion 1*a*, side portions 1*b* and 1*c* are bent from three directions, is made larger than, for example, the relief portion 102*c* provided at the bent portion on the ridge line where only the bottom portion 1*a* and the side portion 1*b* are caused to cross each other.

In the above description an example is described in which the relief portion 102*c* after primary compression is included in a region cut off when cutting the primary compressed article 20 in the secondary blank processing step. However, for example, where surface processing accuracy and excellent appearance are not required on the inner surface of a formed wooden article 1, the relief portion 102*c* may remain on the cut surface 21*f* after the compression is finished. That is, it is possible to adequately set the depth of the relief portion 102*c*.

Next, a description is given of a modified version of the second embodiment.

The modified version is an example in which the shape of a relief portion formed in the primary blank member according to the second embodiment is altered. Hereinafter, a description is given mainly of points which differ from the second embodiment described above.

Figure 16:
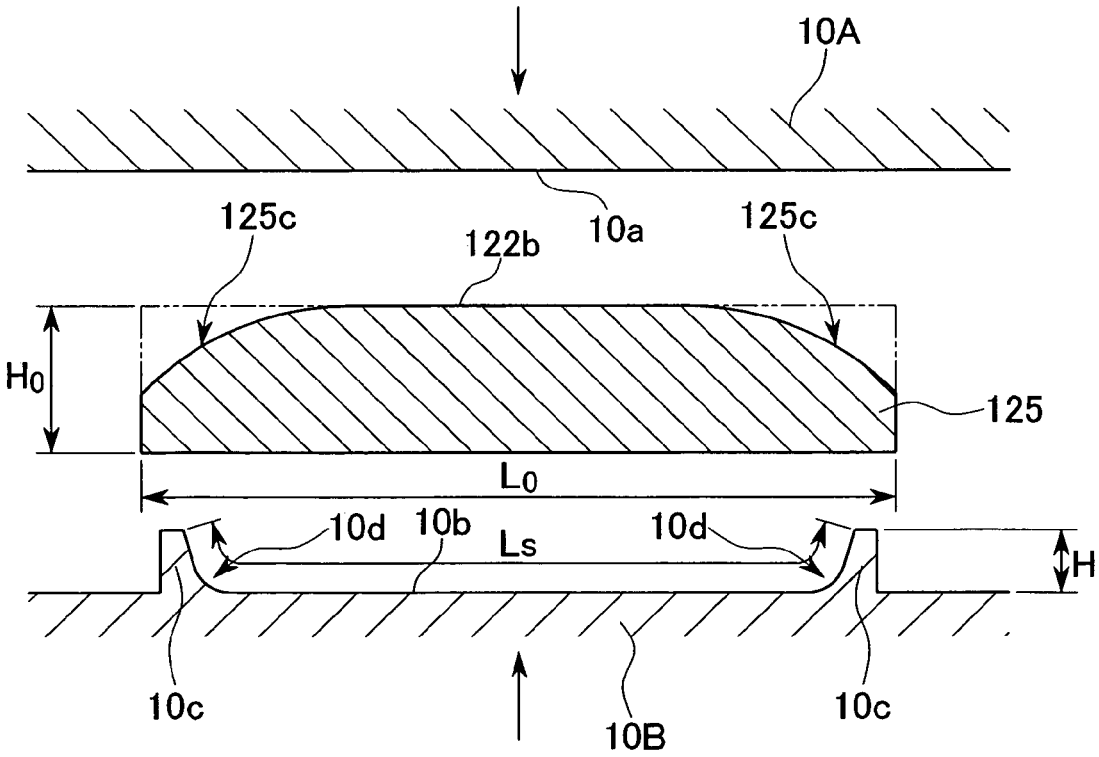
FIG. 16 is a sectional view showing the primary molding dies and a primary blank member to be compressed by the primary molding dies, in the primary compression step in the method according to a modified variation of the second embodiment of the present invention.
Figure 17:
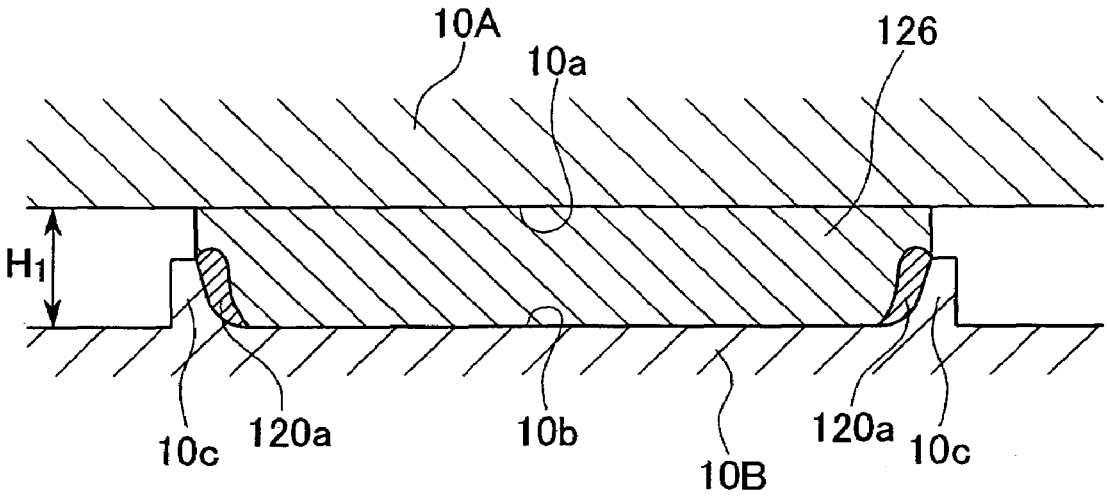
FIG. 17 is a sectional view showing the primary molding dies and the primary blank member compressed by the primary molding dies, which is a primary compressed article, in the primary compression step in the method according to a modified variation of the second embodiment of the present invention.

FIG. 16 and FIG. 17 are sectional views for describing a primary compression step in the method according to the modified version.

As shown in FIG. 16 and FIG. 17, in the modified version, the primary compression step is carried out using a primary blank member 125 instead of the primary blank member 102 according to the second embodiment described above, so as to form the primary compressed article 126. The primary blank member 125 is, as shown in FIG. 16, such that an inclined cut portion 125*c* (relief portion for primary compression) is provided instead of the relief portion 102*c* of the primary blank member 102. The inclined cut portion 125*c* is such that a gently inclined plane is formed by cutting the ridge portion on the rear side 122*b* of a rectangular solid primary blank member 125 whose length is LO, width is WO, and height is $H_0$. Thereby, as shown in FIG. 17, it is possible to adequately set the size and the compression ratio of a high compression portion 120*a* in the vicinity of the protrusion portion 10*c*.

Further, in the modified version, although the inclined cut portion 125*c* is like a curved, it may be chamfered to be like a plane or may be adequately altered so that the shape of the section becomes a curved surface such as, for example, a corrugation. The way of setting the size of the inclined cut portion 125*c* is similar to that in the case of the relief portion 102*c*.

According to the modified version, by adequately varying the cutting amount and the shape of the inclined cut portion 125*c*, it is possible to widely cope with generation of a high compression portion due to the shape of the protrusion portion 10*c*.

In addition, in the second embodiment described above, a description was given of an example of a primary blank member 102 in which a V-shaped groove relief portion 102*c* is formed on a rectangular solid block member, and in the modified version, a description was given of an example of a primary blank member 125 in which an inclined cut portion 125*c* whose ridge portion is cut off is formed on a rectangular solid block member. However, the shape of the primary blank member is not limited to a rectangular solid, and may be adequately altered in compliance with the shape of a formed wooden article. For example, various shapes such as a cylind000rical shape, semi-spherical shape, a conical shape, etc., may be employed. Also, the shape of the relief portion may be adequately altered as necessary based on respective shapes of the primary blank members.

For example, the curved surface shape formed in each portion of the primary blank members 102 and 125 in the above description are provided in compliance with the curved surface shape of respective part of a formed wooden article according to the embodiment.

According to the embodiment of the present invention, since in the primary compression step, a shape substantially the same as the final three-dimensional shape of the formed wooden article is transferred onto the primary blank member, and a primary compressed article is processed in which a high compression portion of a higher compression ratio than that in the surrounding portion is formed in the vicinity of a portion on which the substantially same shape as the final three-dimensional shape is transferred, it is possible to transfer a three-dimensional shape onto a primary compressed article in a state where compression resistance is comparatively low. In the secondary blank processing step, the shape of the secondary blank member is adjusted by adequately cutting the primary compressed article with a shape substantially the same as the final three-dimensional shape left over on the surface of the primary compressed article, and in the secondary compression step, the secondary blank member is compressed by the secondary molding dies, and the final three-dimensional shape is transferred onto the secondary blank member. That is, the shape of the secondary blank member is adjusted prior to the second compression step, therefore, it is possible to lower the compression resistance and compression amount of the secondary blank member compressed in the second compression step. As a result, a pressing force required in the secondary compression step can be lowered, and it is possible to prevent cracks of a formed wooden article through reducing the load applied to the formed wooden article.

Further, since the portion formed in the primary compression step and remaining without being cut in the secondary blank processing step is formed with comparative low compression resistance in the primary compression step, the appearance of the surface thereof is excellent. Since the portion is compressed conforming the three-dimensional shape of the secondary molding die in the secondary compression step, the appearance thereof is not subjected to any deterioration due to, for example, rubbing against the secondary molding die even in the second compression.

Herein, the relief portion is formed to reduce the compression ratio. The relief portion is, for example, a depression formed in the primary blank member or a tapered portion formed so that the thickness of the primary blank member is made thin.

According to the embodiment of the present invention, in the primary compression step, the load on the primary blank member is reduced according to the amount of the relief thus formed. Therefore, it is possible to prevent breakage of the wooden fibers caused by a tensile force on the rear side of the relief portion.

Also, in the secondary blank processing step, the primary compressed article is processed to be a secondary blank member with the three-dimensional shape transferred to be high compression portion left on the surface thereof. However, at this time, since the relief portion is eliminated, no trace of the relief, which is cut in the primary blank forming step, is left in the final formed wooden article.

According to the embodiment of the present invention, since the relief portion is provided on the rear side of the portion of the primary blank member brought into contact with the bent portion on the die surface of the primary molding die, the compressive force acting on the primary blank member from the bent portion of the primary molding die in the primary compression step is relieved by the relief portion, whereby the compression ratio is reduced. For this reason, since the tensile force at the portion brought into contact with the bent portion is reduced, load on the formed wooden article is lowered, and it becomes possible to prevent the wooden fibers from being torn.

According to the embodiment of the present invention, since, in the secondary blank processing step, the primary compressed article is cut so that the thickness thereof may be small at the portion where the high compression portion is formed to be relatively thick, and may be large at the portion where the high compression portion is formed to be relatively thin, the compression ratio, in the secondary compression step, of the high compression portion cut so that the thickness is made small in the secondary blank processing step is relatively small while the compression ratio, in the secondary compression step, of the high compression portion cut so that the thickness becomes large in the secondary blank processing step is made comparatively large. Therefore, it is possible to produce a formed wooden article whose compression ratio is entirely uniform.

According to the embodiment of the present invention, since, in the secondary blank processing step, the primary compressed article is cut so that the portion having a thickness in the direction crossing the sliding direction of the secondary molding die is made thinner than the portion having a thickness in the sliding direction of the secondary molding die, the compressive force of the portion having a thickness in the direction crossing the sliding direction of the secondary molding die can be made smaller in the secondary compression step. Therefore, the compression resistance in the secondary compression step is reduced. Accordingly, with molding dies sliding only in one direction, it becomes possible to easily form a formed wooden article having a three-dimensional shape.

In addition, in order to more efficiently reduce the compression resistance in the secondary compression step, it is preferable that the portion having a thickness in the direction crossing the sliding direction of a secondary molding die be made thinner according to a decrease in the crossing angle. For example, it is preferable that the portion extending in substantially the same direction as the sliding direction of the secondary molding die be made thinnest.

According to the embodiment of the present invention, in the primary compression step, a shape substantially the same as that of the side portion of a formed wooden article bent from the periphery of the bottom portion extending in a direction substantially orthogonal to the sliding direction of the secondary molding die toward the sliding direction of the secondary molding die is transferred onto the primary blank member, and the portion on which the shape substantially the same as that of the side portion is transferred is made into a high compression portion. Therefore, when forming is carried out by sliding the secondary molding die in one direction, even the side portion of a formed wooden article which is likely to be formed worse is formed at high accuracy in the primary compression step, and the article is compressed without deterioration in accuracy in the secondary compression step. Therefore, it is possible to easily produce a formed wooden article having high surface processing accuracy and excellent appearance.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A method for producing a formed wooden article by cutting out a primary blank member from a raw wood and forming the same to a final three-dimensional shape having a substantially uniform thickness, comprising:

a primary compression step in which the primary blank member cut out from the raw wood is compressed by primary molding dies having die surfaces with a shape substantially the same as the final three-dimensional shape of the formed wooden article, and the primary blank member is processed into a primary compressed article having a high compression portion, the high compression portion being formed in a vicinity of portions of the primary blank member corresponding to the die surface and having a higher compression ratio than that in a surrounding of the high compression portion;

a secondary blank processing step in which the primary compressed article is cut and processed into a secondary blank member whose surface keeps a three-dimensional shape transferred onto the high compression portion; and a secondary compression step in which the secondary blank member is compressed by using secondary molding dies and the final three-dimensional shape is transferred onto the secondary blank member.

2. The method for producing a formed wooden article according to claim 1, further comprising:

a primary blank forming step for forming a relief portion on a rear side of a portion of the primary blank member when cutting out the primary blank member from the raw wood, where the portion is to be formed to substantially the same shape as the final three-dimensional shape of the formed wooden article.

3. The method for producing a formed wooden article according to claim 2, wherein the relief portion is formed on a rear side of a portion brought into contact with a bent portion on the die surface of the primary molding die.

4. The method for producing a formed wooden article according to claim 1, wherein the primary compressed article is cut so that a thickness thereof is made smaller at a portion where the high compression portion is formed to be relatively thick and is made larger at a portion where the high compression portion is formed to be relatively thin to process the primary compressed article into the secondary blank member.

5. The method for producing a formed wooden article according to claim 1, wherein the primary compressed article is cut so that a portion having a thickness in a direction crossing a sliding direction of the secondary molding die is made thinner than a portion having a thickness in the sliding direction of the secondary molding die to process the primary compressed article into the secondary blank member.

6. The method for producing a formed wooden article according to claim 1, wherein the formed wooden article finally presents a three-dimensional shape having a bottom portion extending in a direction substantially orthogonal to a sliding direction of the secondary molding die and side portions bending from the periphery of the bottom portion toward the sliding direction of the secondary molding die; and wherein substantially the same shape as that of the side portion is transferred onto the primary blank member through the primary compression step, and a portion onto which substantially the same shape as that of the side portion is transferred, of the primary blank member, is the high compression portion.

7. The method for producing a formed wooden article according to claim 2, wherein the relief portion is provided to reduce a forming load of the primary blank member when primarily compressing the primary blank member into the primary compressed article.

8. The method for producing a formed wooden article according to claim 7, wherein the primary compression article is cut to remove the relief portion in the secondary blank processing step.

9. The method for producing a formed wooden article according to claim 4, wherein the secondary blank member is compressed so that the thickness of the portion where the high compression portion is formed to be relatively thick is substantially equal to that of the portion where the high compression portion is formed to be relatively thin in the secondary blank processing step.

10. The method for producing a formed wooden article according to claim 5, wherein the secondary blank member is compressed so that the thickness of the portion having the thickness in the direction crossing the sliding direction of the secondary molding die is substantially equal to that of the portion having the thickness in the sliding direction of the secondary molding die in the secondary blank processing step.

* * * * *